US005373771A

United States Patent [19]

Weik et al.

[11] Patent Number: 5,373,771

[45] Date of Patent: Dec. 20, 1994

[54] BRASS AND WIND MUSICAL INSTRUMENT ATTACHMENT AND METHOD RELATED THERETO

[76] Inventors: Christopher C. Weik, 12830 Burbank Blvd. #105, North Hollywood, Calif. 91607; Barry S. Pyne, 65 Eloise St., Pasadena, Calif. 91107

[21] Appl. No.: 72,439

[22] Filed: Jun. 7, 1993

[51] Int. Cl.[5] ..... G10D 9/06

[52] U.S. Cl. ..... 84/400; 181/191

[58] Field of Search ..... 84/400; 181/191

[56] References Cited

U.S. PATENT DOCUMENTS 4,998,959 3/1991 Purdie .

*Primary Examiner*—Howard B. Blankenship
*Assistant Examiner*—Patrick J. Stanzione

[57] ABSTRACT

A sound reflector device for symmetrical association, in spaced relationship, with the bell or sound-emitting end or any other orifice of a musical instrument whereby a portion of sound is reflected rearwardly from the sound-emitting end of the instrument towards the ears of the player.

The sound reflector permits the playing of a musical instrument whereby the player, because of the rearwardly reflected sound, has a truer appreciation of the sound being emitted.

10 Claims, 1 Drawing Sheet

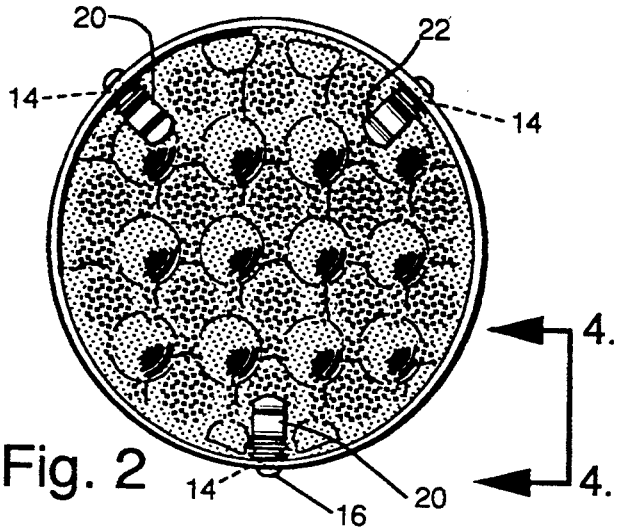
Fig. 2
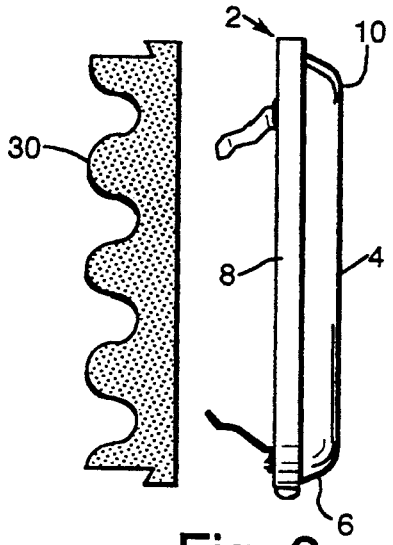
Fig. 3
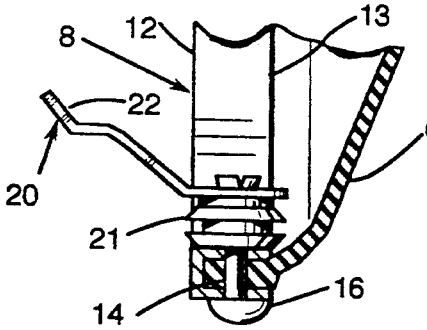
Fig. 7
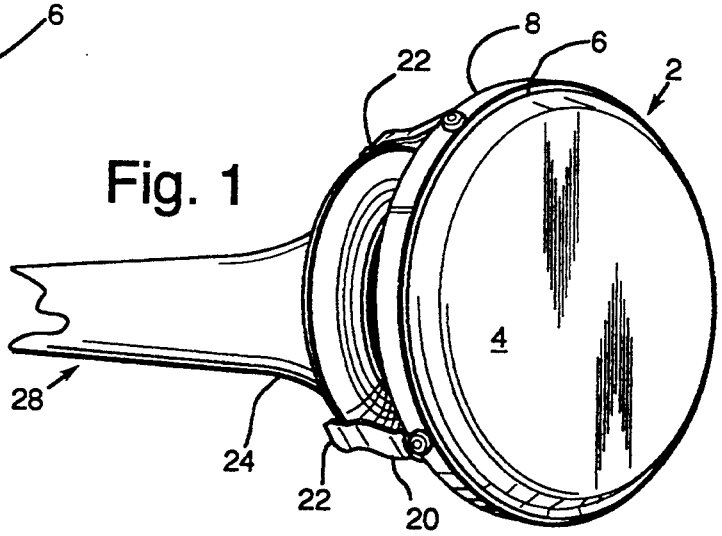
Fig. 1
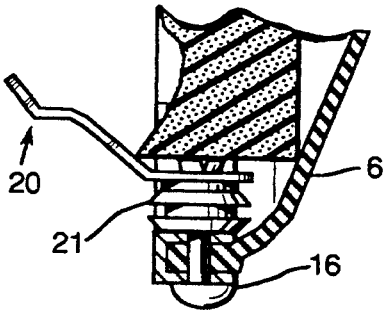
Fig. 4
Fig. 5
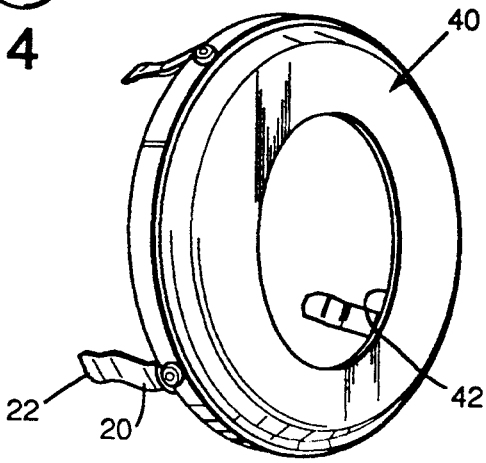
Fig. 6
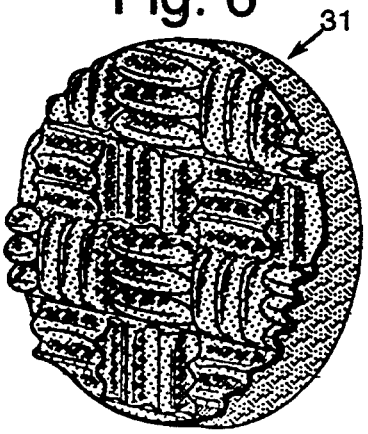

BRASS AND WIND MUSICAL INSTRUMENT ATTACHMENT AND METHOD RELATED THERETO

FIELD OF THE INVENTION

This invention pertains to what may be termed a sound reflector for integral association with a brass and wind musical instrument and which allows for a unique method of playing the instrument with which the inventive device is associated. The attachment has as its basic concept a symmetrical association with the bell end of a musical instrument but, more importantly, that the association be symmetrical and that the device be positioned spaced from and adjacent to the bell in symmetrical manner.

BACKGROUND OF THE INVENTION

Various attachments for, for example, brass instruments having a bell component have been suggested for a variety of reasons including muting, partial reflection and/or partial deflection of sound emanating from the wind instrument.

However, none of the known instrument attachments provide for the unique symmetrical association as does the instant invention for the purpose of reflecting sound in what may be considered symmetrical fashion rearwardly towards the player of the instrument. Usually, sound projects out of the bell of the instrument, away from the player. The audience hears the sound, both direct out of the instrument and reflected off the room or venue walls where the instrument is played.

Musicians and the like have longed for the ability to be able to change sound wave form promulgation and also change the timbre of an instrument so that certain sounds can be reflected and/or absorbed depending upon certain end results desired. Many means have been suggested in the prior art for achieving this, but none have succeeded to the point that professional musicians with a trained ear for sound have been completely satisfied with the end results. An acoustic lens is a device which alters the propagation of a waveform. The device of this invention acts in this manner. In one case, the air coming out of the bell of the trumpet contacts the diaphragm. The phase relationship at this point is reversed 180° and some of the soundwave reverses its course.

With the herein disclosed invention, it is possible to achieve all of the aforementioned attributes in a single attachment that is adapted for symmetrical, spaced association with the bell or other sound projecting end of a wind instrument. Additionally, by the utilization of the device of the invention, one learning to play a musical instrument is for the first time surrounded with true sound that he himself is generating and thus obtains a true understanding and measure of the sounds that are generated with the musical instrument that he is learning to play.

As exemplary of some of the prior art, a preliminary patentability search of the U.S. Patent Office records was conducted and the following patents were uncovered by the search:

| Patent No. | Inventor | Issue Date |
|---|---|---|
| 1,045,700 | J. J. Greenwood | Nov. 26, 1912 |
| 1,508,024 | William A. McArthur | Sept. 9, 1924 |
| Des. 69,112 | H. L. Buskey | Dec. 29, 1925 |

-continued

| Patent No. | Inventor | Issue Date |
|---|---|---|
| 2,574,591 | W. W. Rudd | Nov. 13, 1951 |
| 3,016,782 | W. E. Laas | Jan. 16, 1962 |
| 3,392,619 | R. M. Hill | July 16, 1968 |
| 3,099,183 | E. H. Alles | July 30, 1963 |
| 3,429,215 | Gerald H. Finch | Feb. 25, 1969 |
| 3,555,956 | Daniel W. Martin | Jan. 19, 1971 |
| 3,760,679 | Benjamin R. Gossick; Karl A. Schneider | Sept. 25, 1973 |
| Re. 30,300 | Thomas L. Ploeger | Jun. 10, 1980 |
| 4,226,162 | Alfred Ebach | Oct. 7. 1980 |
| 4,998,959 | Thomas Purdie | Mar. 12, 1991 |

A more in-depth description of each of the pertinent patents follows:

RE30,300 (U.S. Pat. No. 4,012,983)

This Patent is directed to an acoustical reflector for use on the bell of a wind instrument. The device, which is asymmetrical, is shown in FIG. 1 and includes panel 20 supported on bell 14 by means of bracket structure 22. Panel 20 has an acoustically reflective surface 21 generally facing bell 14, as shown in FIG. 2. The device is intended to reflect the sound emanating from the bell of an instrument to be directed back toward the musician. Panel 20 may also be adjusted in a lateral direction in order to face other musicians to the right or left of the performer, as seen in FIG. 3. At column 3, Line 53, it is pointed out that the invention is equally applicable to brass instruments. It is obvious from the Figures that an air space does exist between reflector 20 and 14, but is not symmetrical so as to allow projection of sound entirely around the bell of the instrument.

U.S. Pat. No. 4,998,959

This reference is directed to a mute for horn-type instruments having a generally circular configuration for abutting engagement with the bell. This dish-shaped mute is adapted to fit over the outside of the bell. Referring to the Figures, the body 16 may be flat, convex, or concave, and may be fabricated of wood, metal, or any other resonant material. The device is attached to the bell by means of adjustable fittings 22 and 24, which comprise set screws 26 and 27 with fittings 28 and 29. Positioning of the mute with respect to the bell is made possible by means of grooves 30 in connection with set screws 26 and 27 as shown in FIG. 7.

U.S. Pat. No. 1,508,024

This Patent is directed to a mute for wind instruments which may be easily snapped into engagement over the bell of said instrument. The device is held in position by means of arms D which engage the bell F through a frictional fit between arms D and bell F. The space J within sleeve A constitutes a sound chamber and is adapted to obtain a desired tone effect.

U.S. Pat. No. 3,392,619

This reference is directed to a sound attenuator for use on a wind instrument and demonstrates the use of a sound attenuating material such as foamed rubber or plastic. This is shown at numeral 24 in FIG. 2.

U.S. Pat. No. 3,555,956

This reference is directed to an acousto-electrical transducer for a wind instrument. Referring to FIG. 1, trumpet bell 10 with rim 11 is secured over opening 12 of the device. Opening 12 communicates with space 14 which contains a microphone 15. The remainder of the enclosure, exclusive of open space 14, is filled by masses 16 and 16A of highly absorptive material. Thus, the device provides for the muting of the sound from the instrument with a provision for amplification by means of microphone 15.

U.S. Pat. No. 3,555,956

This reference provides a second example of a musical instrument mute that includes provision for sound amplification. Referring to FIG. 4, there is disposed within chamber 21 a body of resilient sponge material 23, such as sponge rubber, and a microphone pick-up device 24 embedded therein. Microphone 24 is connected by suitable conductors 25 and extend through apertures 22 to a pair of microphone jacks 26.

SUMMARY AND OBJECTS OF THE INVENTION

It is an object of the invention to provide a uniquely configured sound reflector for association with a wind instrument.

It is another important object of the invention to provide a specifically configured attachment for the bell of a wind instrument for symmetrical reflection of the sound emanating from said wind instrument.

It is still another important object of the invention to provide an attachment for wind instruments and the like that permits symmetrical placement of the device in relation to the instrument and which permits sound to be partially reflected from the instrument during playing thereof.

It is another important object of the invention to provide an attachment for the bell of a wind instrument, for example, spaced juxtaposition to the bell of the instrument to allow for partial reflection of the sound towards the player of the instrument.

It is another important object of the invention to provide a device for attachment to the bell of a wind instrument which has quick release and engagement legs for association with the bell of the win instrument with which it is associated and which provides for standoff placement therefrom.

It is still another important object of the invention to provide a device which, when associated with the sound emitting portion of a wind instrument, is symmetrically positioned so as to permit the player of the instrument to hear in a more true fashion the sounds that he is making on the instrument, thereby permitting improved learning with respect to the playing of said instrument.

These and other objects of the invention are generally accomplished by having a sound reflector for musical instruments wherein the musical instrument has a bell and wherein the reflector comprises the combination of a member congruently shaped to the configuration of the bell of the instrument to which the member is to be attached. Attachment means for attaching the member in spaced relationship to the instrument bell are utilized wherein the attachment means are adapted to maintain the member an equidistance away from the bell of the instrument, whereby at least some sound emitted from the bell of the instrument is projected rearwardly from the bell, in a symmetrical fashion, relative to the bell of the musical instrument. In using the sound reflector of the invention a new method of learning to hear and listen to the musical sounds emitted from the musical instrument is attained inasmuch as the beginning player is able to hear in a more true fashion the sounds that the player is emitting from the wind instrument by reason of the sound reflector reflecting sound rearwardly towards the player's ears so that he can have a real sense of the sounds being emitted.

These and other objects of the invention will become apparent from the hereinafter following commentary taken in conjunction with the drawings.

BRIEF DESCRIPTION OF THE DRAWINGS

FIG. 1 is a perspective view of the sound reflector of the invention attached to the bell of a wind instrument;

FIG. 2 is a frontal view of the sound reflector of the invention taken from a point distant from the bell of the instrument;

FIG. 3 is an exploded view of the sound reflector of the invention as depicted in FIG. 2 showing a sound absorbing cushion member useful in the invention;

FIG. 4 is an enlarged view taken on the line 4—4 of FIG. 2;

FIG. 5 is a perspective view of an alternative embodiment of the invention showing the sound reflector with a center aperture;

FIG. 6 is a view of another sound-absorbing and sound-changing cushion member that is inserted into the sound reflector as depicted in FIG. 1; and FIG. 7 is a view similar to FIG. 4 but with the member removed for purposes of clarity.

DETAILED DESCRIPTION OF A PREFERRED EMBODIMENT

Referring to the figures of drawing wherein like numerals of reference designate like elements throughout, it will be seen that sound reflector 2 is of circular configuration having what may be considered a first flat surface 4 extending into a dish configuration with surrounding annular portion 6 terminating in juxtaposition to rim member 8.

The material of construction for the dish-shaped member 10, formed by the flat surface 4 and the upward sides of shoulder or annular portion 6 is of flexible construction, of the type normally associated with drumheads and in this particular instance has a shiny or reflective surface, similar to mylar for the surface 4. The flat surface 4 may be made up of a plurality of layers or of a single layer as shown in drawings, and thus because of its flexible nature, will act very much like a diaphragm in the sense that vibration results. The rim or ring 8 is of metal construction and, as seen, is annular in configuration, is u-shaped in cross-section and has opposed flanges 12 and 13 for receiving and holding the annular edge of sidewall 6 therebetween by means of adhesive or frictional retention, the means of securement not being important to the use of the invention.

The annular ring 8 has, as can be seen from FIG. 4, a u-shaped configuration and in referring to FIG. 2, has spaced apertures 14 therethrough for receiving rivets 16, to not only secure the member 10, but also to rigidly secure extending foot members 20 which, in this particular instance, have an inwardly directed configuration relative to the annular ring 8 and terminates in bell grasping portions 22 for attachment to the bell 24, for example, of wind instrument 28 as best seen in FIG. 1.

Referring to FIGS. 4 and 7, it will be noted that the rivet 16 secures the leg 20 while having an intermediate rubber grommet 21 for vibration purposes and, in order to prevent the legs 20 from scratching the bell 24 of wind instrument 28, the legs 20 may be coated with a rubberized material or the like, not shown.

Under certain conditions it is desirable to be able to utilize a sound-damping or sound-changing member such as insert 30 or 31 which, as seen in FIGS. 3 and 6 may have different shaped surfaces facing the sound-emitting end of the wind instrument with which the sound reflector 2 of the invention is utilized.

The member 30 shown in FIG. 3 has an undulated, outwardly directed surface configuration forming hills and valleys whereas the member 31 shown in FIG. 6 has a specific, rectangular-like, spaced and grooved configuration outer surface for reacting with sound waves and the like, as those of musical learning will at once appreciate.

Referring to FIG. 5, it will be seen that a sound reflector device 40 has the same construction as that described for the device 2 with the exception that a central aperture 42 is provided so that more sound is projected outwardly from the wind instrument with which the device 40 is utilized.

Those of ordinary skill in the art will at once appreciate that the device 2 or device 40 may be easily associated with the bell of a wind instrument or for that matter the sound emitting portion of a wind instrument, it only being important that the sound reflector 2 of the invention be symmetrically positioned with respect to and spaced from the sound-emitting portion or the bell of the instrument with which it is associated.

For example, referring to FIG. 1 wherein the sound reflector 2 not having a sound-dampening or sound-changing insert 30 or 31, is easily associated and disassociated with the bell 24 of wind instrument 28. In the position thus shown, where there is symmetrical placement with respect to the bell 24, the sound reflector 2 will reflect a major portion of sounds rearwardly towards the player, not shown. This then provides the player of the musical instrument 28 with a more true sound appreciation of the sounds being emitted from the instrument 28 while he is playing.

In the practice model of the invention, the acoustical foam sponge insert such as 30 or 31 is used to obtain one or more different characteristics in the musical sound being emitted.

The sound reflector of the invention permits a method of playing and learning to play a musical instrument, particularly a wind instrument such as trumpet, whereby the sound is reflected from the bell of the instrument and projected towards the ears of the player, so as to have a truer representation of the sound being emitted from the instrument.

With out the use of the device of the invention, players mostly hear room refections of sound from the room in which they play the instrument. They also near through bone conduction, so while playing there is an auditory connection. In some cases, echoes are so severe as to cause confusion on the part of the players. One can imagine that by multiplying this condition by the presence of additional instruments, it becomes difficult to hear yourself play and thus the sound reflector of the invention creates a portable monitor-feedback system for the professional and student music player alike.

Those of ordinary skill in the art will, of course, recognize that beginning musicians learning to play a wind instrument will ideally utilize the device 2 associated with a wind instrument 28 so as to have reflected towards him, during his playing, a true indication of the sounds that are emitted frown the instrument during his play.

While various wind instruments will have various shapes, for example a tuba, the sound reflector device 2 of the invention will be similarly modified so as to engage the sound-emitting end or bell of the instrument and thus the sound reflector 2 of the invention would be larger in size. For those instruments that would not be considered as having the typical or conventional bell, it is only important that when using the sound reflector of the invention that the sound reflector be symmetrically shaped or congruently shaped to the sound-emitting portion of the instrument and, further, that it be spaced from the sound-emitting end or bell of the instrument so as to be able to reflect, but not mute, the sound produced by the instrument.

These and other modifications and changes are all matters that will at once make themselves apparent to those of ordinary skill in the art and all such changes and modifications are intended to be covered by the appended claims.

We claim:

1. A sound reflector for musical instruments having a bell comprising the combination of:

a solid, substantially planar member congruently shaped to the configuration of the bell of the instrument to which said member is to be attached, attachment means for attaching said member in spaced relationship to said bell of the instrument, said attachment means being adapted to maintain said member a spaced and an equidistance away from said bell, whereby at least some sound emitted from said bell of the musical instrument is projected rearwardly from said bell in symmetrical fashion relative to said bell of the musical instrument.

2. The sound reflector in accordance with claim 1 wherein the sound reflector is comprised of a resonating portion and a rigid portion for securement to the bell of the instrument.

3. The sound reflector in accordance with claim 2 wherein the attachment means comprises spaced legs adapted for releasable engagement with the bell of said instrument.

4. The sound reflector in accordance with claim 3 wherein the sound reflector has a dish configuration adapted to receive a sound-changing element therein.

5. The sound reflector in accordance with claim 4 wherein the sound-changing element is an absorbent sponge member congruently shaped to the inside surface of said sound reflector.

6. The sound reflector in accordance with claim 1 wherein there is a central aperture symmetrically positioned relative to the perimeter of said sound reflector.

7. The sound reflector in accordance with claim 1 wherein the sound reflector is comprised of a reflective portion on one surface thereof.

8. A sound reflector for musical instruments having a sound-emitting end portion comprising the combination of:

a solid, substantially planar member congruently shaped to the configuration of the sound-emitting end portion of the musical instrument to which said member is to be attached, attachment means for attaching said member in spaced relationship to said sound-emitting end of said instrument, said attachment means being adapted to maintain said member a spaced and an equidistance away from said sound-emitting end of said musical instrument, whereby at least (some) a majority of the sound emitted from said sound-emitting end of said musical instrument is projected rearwardly from said sound-emitting end of said musical instrument in a symmetrical fashion relative to said sound-emitting end of said musical instrument.

9. The method of learning to play a wind instrument having a sound-emitting end comprising the steps of:

(a) placing a solid sound reflector congruently shaped to the sound-producing end of said instrument in spaced relationship therefrom to permit sound to be symmetrically reflected toward the player of said instrument;

(b) playing said musical instrument and having sound being emitted from said sound-emitting end of said musical instrument whereby the player of said instrument is given a true appreciation of the sound being emitted from said musical instrument.

10. A sound reflector for musical instruments having a bell comprising the combination of:

a member congruently shaped to the configuration of the bell of the instrument to which said member is to be attached, attachment means for attaching said member in a spaced relationship to said bell of the instrument, said attachment means being adapted to maintain said member an equidistance away from said bell, whereby at least some sound emitted from said bell of the musical instrument is projected rearwardly from said bell in symmetrical fashion relative to said bell of the musical instrument, said sound reflector being comprised of a resonating port-ion and a rigid portion for securement to the bell of the instrument, said attachment means comprising spaced legs adapted for releasable engagement with the bell of said instrument, said sound reflector having a dish configuration which is adapted to receive a sound-changing element therein, a sound-changing element said sound-changing element being an absorbent sponge member congruently shaped to the inside surface of said sound reflector.

* * * * *